US008037639B2

(12) United States Patent
Watanabe et al.

(10) Patent No.: US 8,037,639 B2
(45) Date of Patent: Oct. 18, 2011

(54) DOOR OPENING/CLOSING DEVICE

(75) Inventors: Hirofumi Watanabe, Yamanashi (JP); Takuya Kakumae, Yamanashi (JP); Kazuhito Yokomori, Yamanashi (JP); Nobuo Sugawara, Yamanashi (JP)

(73) Assignee: Mitsu Kinzoku Act Corporation, Yokohama-shi (JP)

( * ) Notice: Subject to any disclaimer, the term of this patent is extended or adjusted under 35 U.S.C. 154(b) by 598 days.

(21) Appl. No.: 11/369,940

(22) Filed: Mar. 8, 2006

(65) Prior Publication Data

US 2007/0084122 A1 Apr. 19, 2007

(30) Foreign Application Priority Data

Oct. 13, 2005 (JP) ..... 2005-298735

(51) Int. Cl.
*E05F 15/10* (2006.01)

(52) U.S. Cl. ..... 49/340; 49/339; 49/341

(58) Field of Classification Search ..... 49/339, 49/340, 341; 296/56
See application file for complete search history.

(56) References Cited

U.S. PATENT DOCUMENTS

| | | | | |
|---|---|---|---|---|
| 5,039,925 | A * | 8/1991 | Schap | 318/282 |
| 5,878,530 | A * | 3/1999 | Eccleston et al. | 49/139 |
| 6,092,336 | A * | 7/2000 | Wright et al. | 49/339 |
| 6,222,359 | B1 * | 4/2001 | Duesler et al. | 324/207.12 |
| 6,310,473 | B1 * | 10/2001 | Zhao | 324/207.25 |
| 6,417,662 | B1 * | 7/2002 | Wallrafen | 324/174 |
| 6,601,903 | B2 * | 8/2003 | Nakagome | 296/76 |
| 6,964,449 | B2 * | 11/2005 | Takeda et al. | 296/146.4 |
| 7,070,226 | B2 * | 7/2006 | Cleland et al. | 296/146.8 |
| 7,140,150 | B2 * | 11/2006 | Sakai et al. | 49/340 |
| 2003/0221371 | A1 * | 12/2003 | Yokota et al. | 49/342 |
| 2004/0256881 | A1 * | 12/2004 | Takeda et al. | 296/146.2 |
| 2006/0267581 | A1 * | 11/2006 | Wiese | 324/207.25 |

FOREIGN PATENT DOCUMENTS

| | | | |
|---|---|---|---|
| JP | 54-148578 | A | 11/1979 |
| JP | 59-041882 | A | 3/1984 |
| JP | 11-324482 | A | 11/1999 |
| JP | 2000-179233 | A | 6/2000 |
| JP | 2001-253242 | A | 9/2001 |
| JP | 2002-089133 | A | 3/2002 |
| JP | 2004-036108 | A | 2/2004 |
| JP | 2004-036193 | A | 2/2004 |
| JP | 2004-175235 | A | 6/2004 |
| JP | 2005-076319 | A | 3/2005 |

(Continued)

OTHER PUBLICATIONS

Magnetoresistance, http://en.wikipedia.org/wiki/Magnetoresistance.*

(Continued)

*Primary Examiner* — Gregory J. Strimbu
(74) *Attorney, Agent, or Firm* — Foley & Lardner LLP

(57) ABSTRACT

In a door opening/closing device having a motor base and a sensor case, a rotation sensor is provided. The rotation sensor includes a magnetic member provided adjacent an end of a rotation shaft and a detecting element that is arranged so as to detect a magnetic flux that is generated from the magnetic member in a direction crossing a magnetic flux that is generated from an electromagnetic clutch arranged around the rotation shaft. The motor base is attached to the sensor case such that the end of the rotation shaft extends outside of the motor base and the rotation sensor is arranged adjacent the end of the rotation shaft.

8 Claims, 11 Drawing Sheets

FOREIGN PATENT DOCUMENTS

| | | | |
|---|---|---|---|
| JP | 2005-163304 | A | 6/2005 |
| JP | 2005-204468 | A | 7/2005 |
| JP | 2005-273142 | A | 10/2005 |
| JP | 2005-273162 | A | 10/2005 |

OTHER PUBLICATIONS

Magnetoresistance, http://en.wikipedia.org/wiki/Magnetoresistance, Jul. 2009.*

* cited by examiner

DOOR OPENING/CLOSING DEVICE

BACKGROUND OF THE INVENTION

1. Field of the Invention

The present invention relates to a door opening/closing device for controlling opening and closing of a door.

2. Description of the Related Art

An opening/closing device for controlling opening and closing of a door of a vehicle is provided with, for example, a slide door disposed on a side of a vehicle body. A driving unit drives the opening/closing device by transmitting a driving force of a motor to a rotational shaft via a clutch mechanism. A slide door is slid according to rotation of the rotational shaft. In the opening/closing device, the rotational shaft is rotatably supported to a case. The rotational shaft supports an output gear and a rotor rotated together therewith in the case. Within this case, a movable plate that is rotatable relative to the rotational shaft and can be engaged with and disengaged from a rotor is supported to the rotational shaft. An armature is fixed to the movable plate. An electromagnetic coil is fixed in the case to be opposed to the armature via the rotor. The electromagnetic coil forms a magnetically closed loop in cooperation with the armature and the rotor to attract the armature toward the rotor. Thus, the movable plate and the rotor are engaged with each other. Furthermore, the driving device includes, within this case, a rotary sensor including an annular magnetic body fixedly arranged outside the closed loop at an outer peripheral edge of the rotor and a hall element facing an outer peripheral face of the magnetic body for detecting rotation of the rotor (Japanese Patent Application Laid-open No. 2000-179233).

In the conventional door opening/closing device, since the magnetic body is fixedly arranged to the outer peripheral edge of the rotor, the magnetic body is arranged at the outermost peripheral position of a driving unit to take on a large annular shape. The hall element to detect the rotation faces the outer peripheral face of the magnetic body. Therefore, a distance between the magnetic body and the hall element in an axial direction of the rotational shaft or in a radially-outward direction tend to vary during rotation of the rotor. As a result, precision of the detection is degraded.

Moreover, the closed loop is formed by the armature and the rotor with an electromagnetic coil. Because the magnetic body is provided on the rotor, the magnetic body is practically affected by the closed loop. Therefore, in the conventional opening/closing device, magnetic flux of the magnetic body varies due to the magnetically closed loop. As a result, the precision of the detection is degraded.

Furthermore, in the conventional door opening/closing device, a main structure of the driving unit is arranged in a case to be integrated with a motor to form a driving unit assembly. The case is fixed to a body of a vehicle via a bracket. Therefore, the case should be a metallic case having rigidity. In addition, since the magnetic body is arranged on the outer peripheral edge of the rotor, and the hall element facing the outer peripheral face of the magnetic body is provided in the case. Therefore, a size of the case becomes large in a radially-outward direction of the rotational shaft and the weight of the entire device increases.

SUMMARY OF THE INVENTION

It is an object of the present invention to at least solve the problems in the conventional technology.

A door opening/closing device according to one aspect of the present invention is for moving a door with rotation of a rotation shaft obtained by transmitting a drive force of a motor to the rotation shaft through an electromagnetic clutch arranged around the rotation shaft. The door opening/closing device includes a rotation sensor. The rotation sensor includes a magnetic member provided at an end of the rotation shaft to be rotationally moved according to the rotation, and a detecting element configured to be fixed at a position having a predetermined distance from the magnetic member, and configured to detect magnetic flux that is generated from the magnetic member, the magnetic flux crossing magnetic flux that is generated from the electromagnetic clutch.

The other objects, features, and advantages of the present invention are specifically set forth in or will become apparent from the following detailed description of the invention when read in conjunction with the accompanying drawings.

DETAILED DESCRIPTION OF THE PREFERRED EMBODIMENTS

Exemplary embodiments according to the present invention will be explained in detail with reference to the accompanying drawings.

FIGS. 1 to 6 depict a door opening/closing device according to a first embodiment of the present invention.

Figure 1:
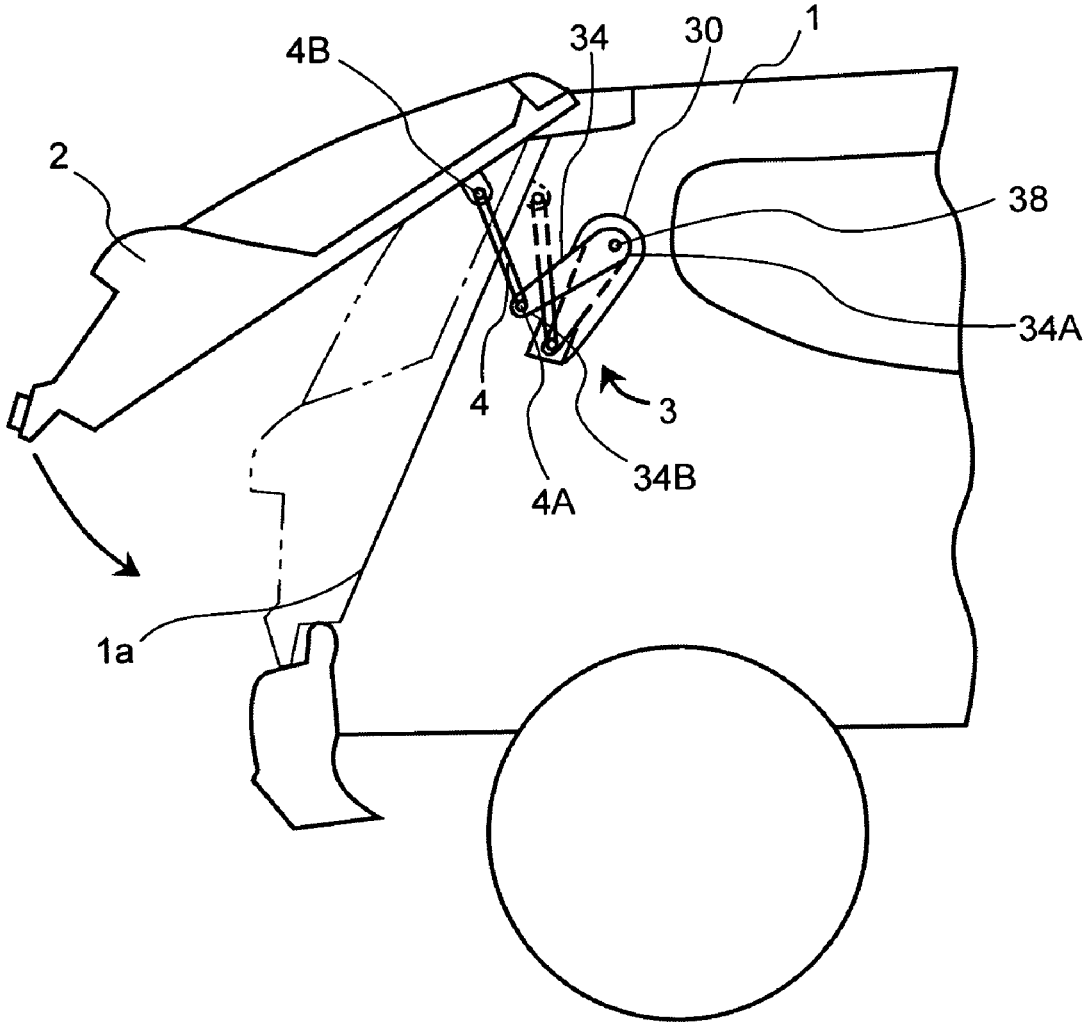
FIG. 1 is a schematic of a door opening/closing device according to a first embodiment of the present invention.

As shown in FIG. 1, the door opening/closing device 3 is provided between a body 1 of a vehicle and a door (for example, a spring-up type rear door) 2 for closing an opening 1*a* that is formed in the body 1. The door opening/closing device 3 moves the door 2 to be open and closed. The door opening/closing device 3 includes a driving unit 30, and a transmission rod 4 arranged between the driving unit 30 and the door 2. The door opening/closing device 3 transmits power of the driving unit 30 to the door 2 via the transmission rod 4, thereby moving the door 2.

As shown in FIGS. 2 to 5, the driving unit 30 is arranged in a casing 3A constituting a base member of the door opening/closing device 3, and has a driving motor 31, a clutch 32, a driving gear group 33, an arm 34, and a rotation sensor 35. The casing 3A is formed by combining a front cover 3Aa and a back cover 3Ab that are obtained by bending metallic plates.

Figure 3:
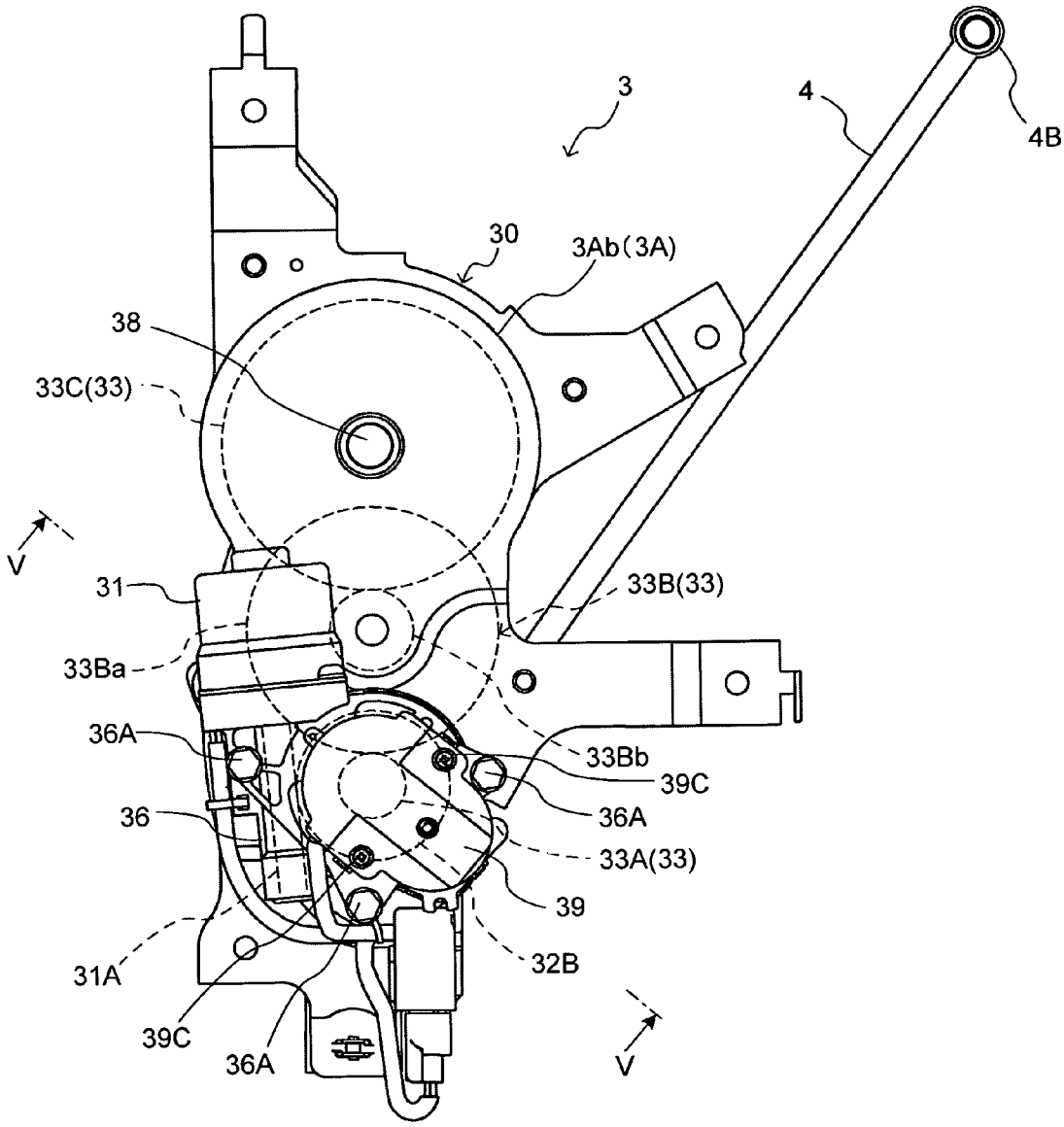
FIG. 3 is a rear view of the door opening/closing device shown in FIG. 1.
Figure 4:
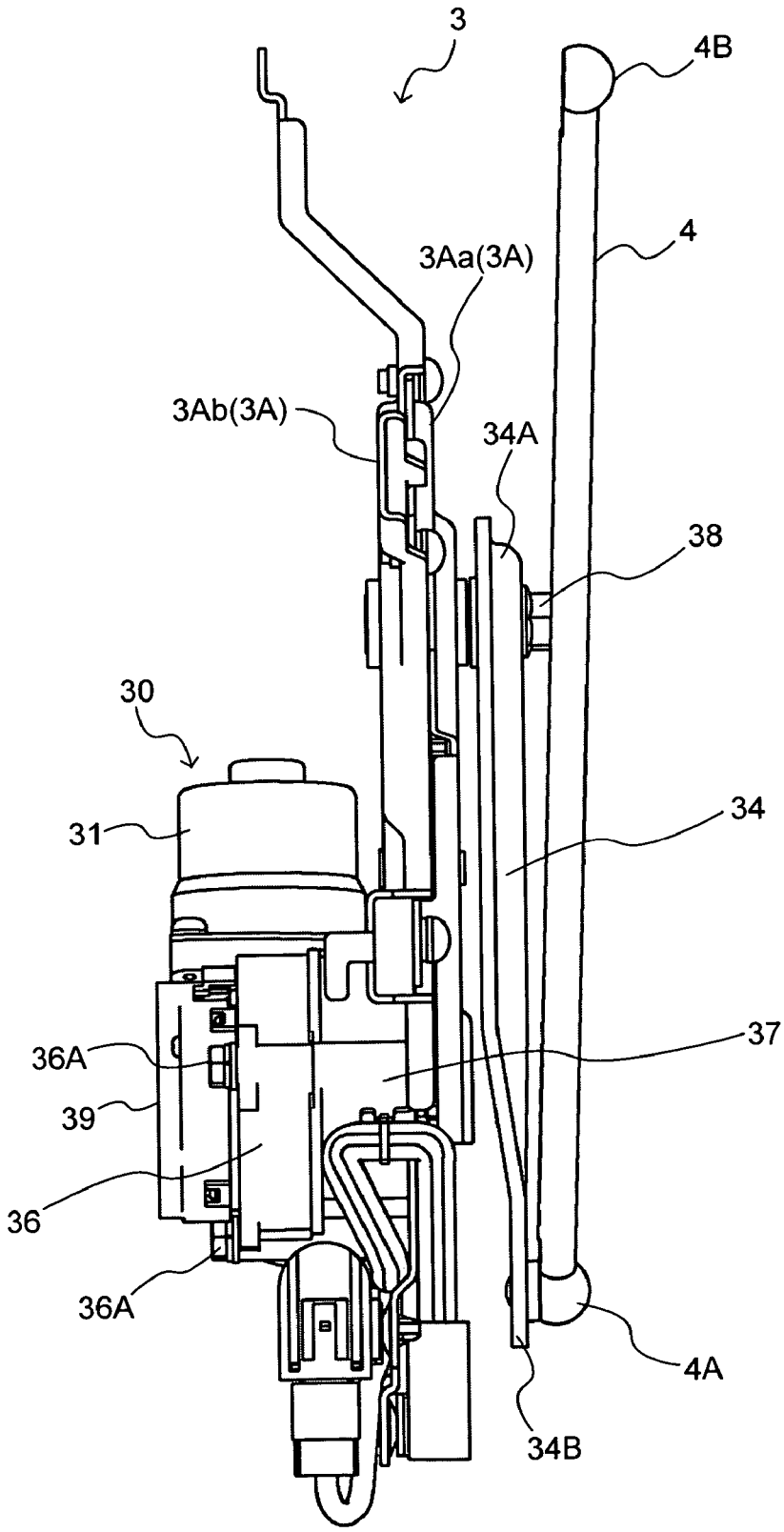
FIG. 4 is a side view of the door opening/closing device shown in FIG. 1.
Figure 5:
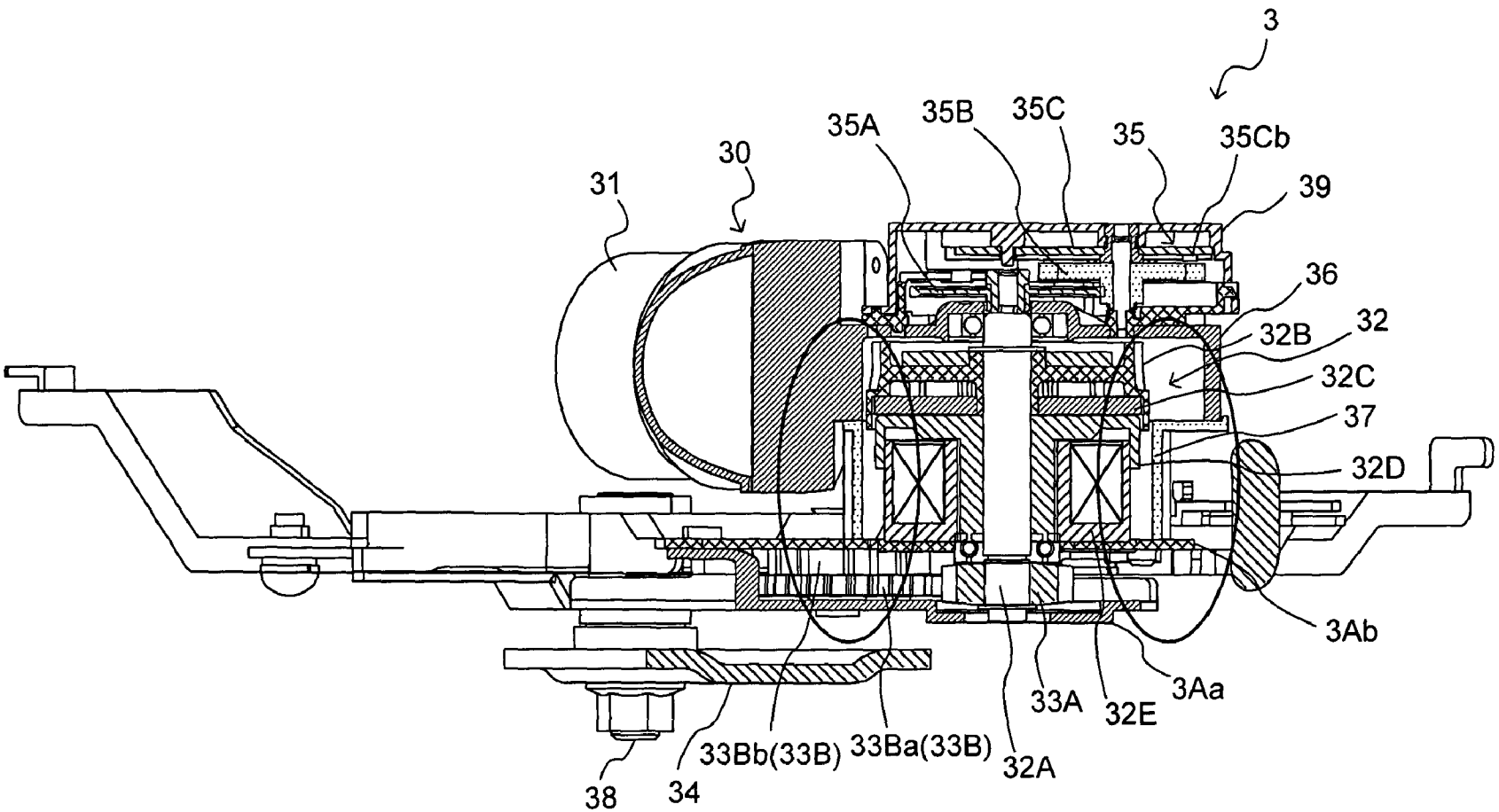
FIG. 5 is a cross-section of the door opening/closing device taken along a line V-V shown in FIG. 3.

As shown in FIGS. 3 to 5, the driving motor 31 is attached to an outer face of the casing 3A, specifically, on the back cover 3Ab. The driving motor 31 is disposed at a substantially central part of the back cover 3Ab such that an output shaft (not shown) thereof extends downward. The output shaft is provided with a worm gear 31A. The driving motor 31 includes a motor base 36 made from metal (for example, aluminum alloy) that houses the output shaft and the worm gear 31A. The driving motor 31 is fixed on the back cover 3Ab with bolts 36A.

As shown in FIG. 5, the clutch 32 is constituted as an electromagnetic clutch. The clutch 32 is housed in a clutch case 37 made from synthetic resin. The clutch case 37 is interposed between the motor base 36 and the back cover 3Ab, and it is fixed to the back cover 3Ab with the bolts 36A.

The clutch 32 includes a rotation shaft 32A, a worm wheel 32B, an armature 32C, a rotor 32D, and a coil unit 32E. One end of the rotation shaft 32A is rotatably supported to the motor base 36 in a state that the rotation shaft 32A is orthogonal to the output shaft of the driving motor 31, while the other end thereof is rotatably supported to the back cover 3Ab of the casing 3A. The worm wheel 32B is rotatably fit on the rotation shaft 32A to mesh with the worm gear 31A of the driving motor 31. The armature 32C is formed in a disc shape from magnetic substance and it is rotatably fit on the rotation shaft 32A. The armature 32C is provided to engage with the worm wheel 32B so as to move in an axial direction of the rotation shaft 32A and rotate together with the worm wheel 32B. The rotor 32D is fixed on the rotation shaft 32A so as to be opposed to the armature 32C. The coil unit 32E is arranged around the rotation shaft 32A. The rotor 32D is arranged between the coil unit 32E and the armature 32C. One end of the rotation shaft 32A extends through the motor base 36, while the other end thereof extends inside the casing 3A.

When the coil unit 32E is energized, the armature 32C is attracted toward the coil unit 32E to frictionally engage with the rotor 32D. Thereby, a driving force of the driving motor 31 via the worm gear 31A and the worm wheel 32B is transmitted to the rotation shaft 32A via the rotor 32D so that the rotation shaft 32A is rotated. On the other hand, when the energization of the coil unit 32E is stopped, the armature 32C and the rotor 32D separate from each other.

Figure 6:
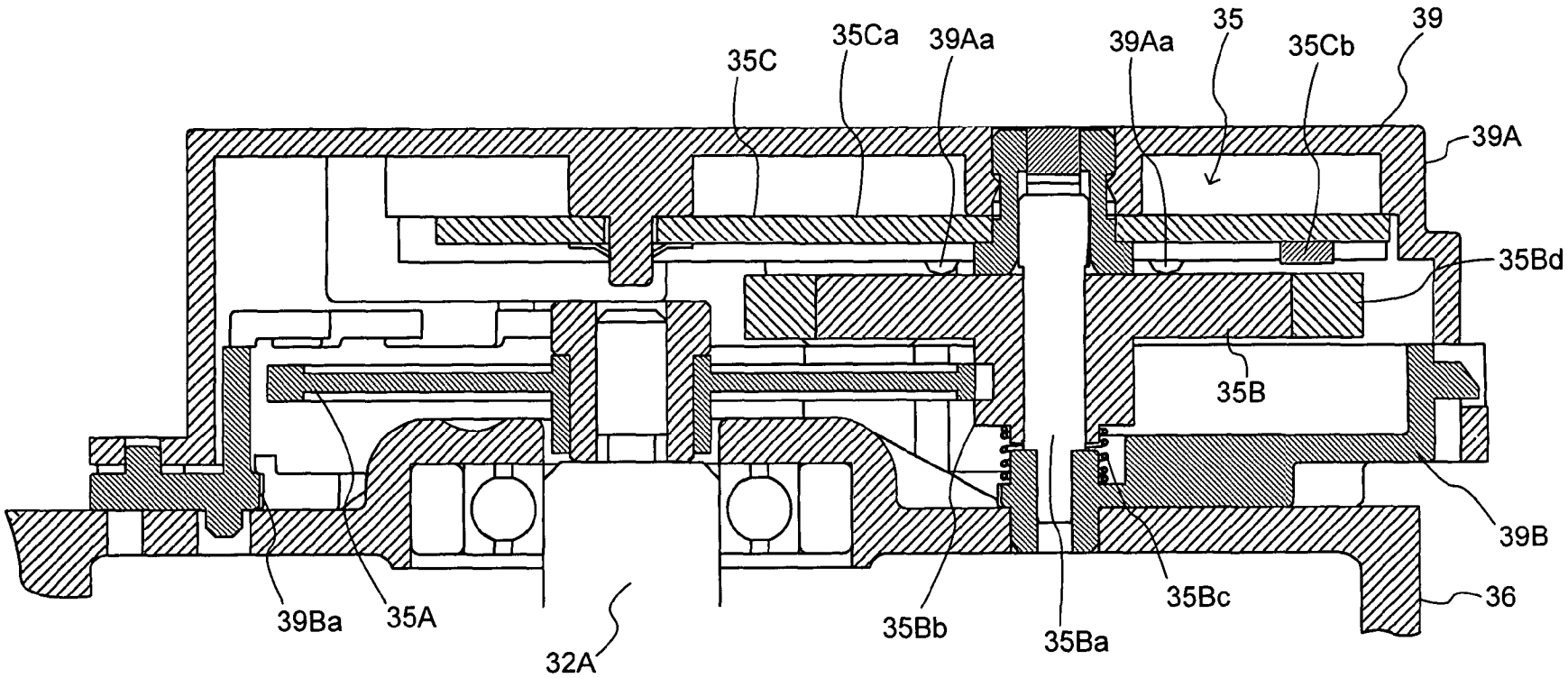
FIG. 6 is an enlarged view of a portion shown in FIG. 5.

As shown in FIGS. 3 and 6, the driving gear group 33 includes an output gear 33A, an intermediate gear 33B, and a driving gear 33C. The output gear 33A is fixed to the other end of the rotation shaft 32A inside the casing 3A. The intermediate gear 33B is supported inside the casing 3A and is constituted by coupling two gears 33Ba and 33Bb. The gear 33Ba meshes with the output gear 33A. The gear 33Bb meshes with the driving gear 33C. The driving gear 33C is supported inside the casing 3A via the driving shaft 38. The driving gear 33C is fixed to the driving shaft 38. The driving shaft 38 extends toward a front face of the casing 3A.

In the driving gear group 33, when a driving force of the driving motor 31 is transmitted to the rotation shaft 32A via the clutch 32, the driving shaft 38 is rotated around by the rotation shaft 32A via the output gear 33A, the gear 33Ba, the gear 33Bb, and the driving gear 33C.

Figure 2:
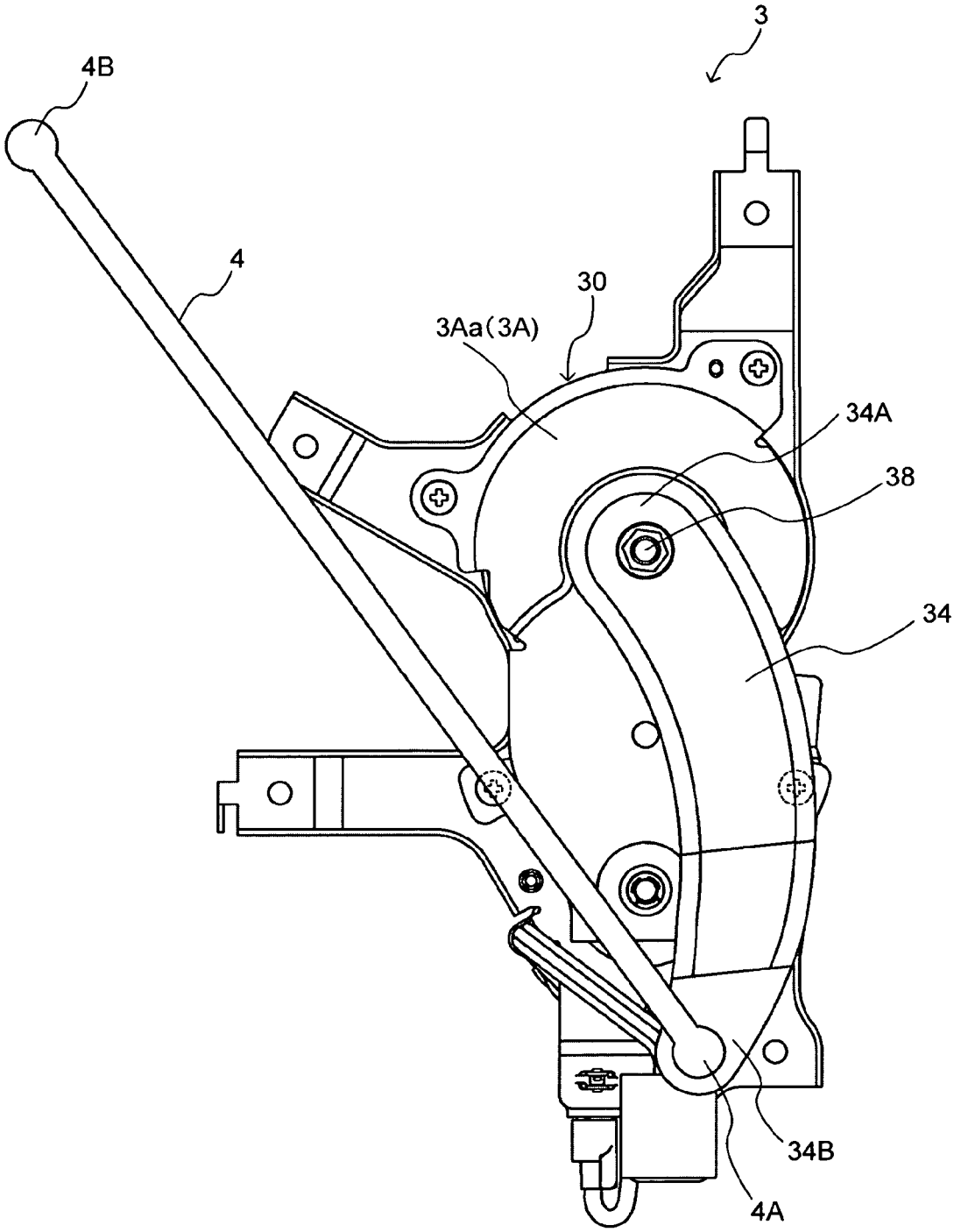
FIG. 2 is a front view of the door opening/closing device shown in FIG. 1.

As shown in FIGS. 2, 4, and 5, a proximal end 34A of the arm 34 is fixed to the driving shaft 38 extending toward the front face of the casing 3A. The arm 34 is eventually rotated according to the rotation of the driving shaft 38. A transmission rod 4 is attached to a rotating end 34B of the arm 34. As shown in FIGS. 1, 2, and 4, the transmission rod 4 is formed in an elongated rod shape, and one end 4A thereof is attached to the rotating end 34B of the arm 34, while another end 4B thereof is attached to the door 2. The transmission rod 4 moves the door 2 in an opening direction to open the door 2 or a closing direction to close the door according to rotation of the arm 34.

As shown in FIGS. 5 and 6, the rotation sensor 35 is housed in a sensor case 39 made from synthetic resin attached to a rear face of the motor base 36. As shown in FIG. 6, the sensor case 39 includes an upper case 39A and a lower case 39B separated from each other, and a sensor gear 35A, a magnet disc 35B, and a sensor unit 35C constituting the rotation sensor 35 are housed in a space formed between the upper case 39A and the lower case 39B.

The sensor gear 35A is fixed at an end of the rotation shaft 32A extending to the outside of the motor base 36.

The magnet disc 35B has a supporting shaft 35Ba rotatably supported to the sensor case 39. In the supporting shaft 35Ba, an upper end portion thereof is supported by the upper case 39A, and a lower end portion is supported by the lower case 39B. The supporting shaft 35Ba includes a meshing teeth 35Bb meshing with the sensor gear 35A. As shown in FIG. 6, a compression spring 35Bc is interposed between a lower end portion of the supporting shaft 35Ba and the lower case 39B. Therefore, the magnet disc 35B is elastically biased upwardly by the compression spring 35Bc. The magnet disc 35B has a permanent magnet 35Bd in a disc shape serving as a magnetic member and extending in a radially outward direction of the supporting shaft 35Ba. The permanent magnet 35Bd is provided to constitute at least an outer peripheral portion in a disc shape extending in the radially outward direction of the supporting shaft 35Ba. The permanent magnet 35Bd is constituted by magnetizing positive pole (N pole) and negative pole (S pole) different in magnetic pole alternatively along a circumferential direction on a disc face (axial).

The sensor unit 35C has a sensor base plate 35Ca fixed to the upper case 39A. The sensor base plate 35Ca has two (a pair of) hall integrated circuits (hereinafter, "hall ICs") 35Cb serving as magnetism detecting elements on a lower face thereof. The respective hall ICs 35Cb are arranged so as to face the disc face (the upper face) of the permanent magnet 35Bd on the magnet disc 35B. In other words, the hall ICs 35Cb are fixedly arranged in a magnetic field generated by the permanent magnet 35Bd so as to detect vertical (a vertical direction in FIGS. 5 and 6) magnetic flux generated from the disc face of the permanent magnet 35Bd of the magnet disc 35B. The respective hall ICs 35Cb are arranged at positions slightly deviated from a position immediately above the coil unit 32E of the clutch 32 sideward.

Supporting projections 39Aa are provided on an inner wall face of the upper case 39A. The supporting projections 39Aa abut on a disc-shaped portion of the magnet disc 35B elastically biased by the compression spring 35Bc. Therefore, the permanent magnet 35Bd and the hall ICs 35Cb are arranged to oppose to each other via a predetermined distance. The predetermined distance is a distance suitable for the hall ICs 35Cb to detect passage of magnetic flux from the permanent magnet 35Bd and output the detected passage as a voltage. Thus, the compression spring 35Bc and the supporting projections 39Aa constitute a supporting unit which elastically holds a position of the permanent magnet 35Bd to positions of the hall ICs 35Cb.

In the rotation sensor 35, an opening hole 39Ba that allows insertion of the sensor gear 35A is provided in the lower case 39B. The sensor case 39 is fixed to an upper face of the motor base 36 by fixing screws 39C (see FIG. 3) so as to insert the sensor gear 35A inside via the opening hole 39Ba. At this time, the sensor gear 35A mutually meshes with the meshing teeth 35Bb of the magnet disc 35B.

In the rotation sensor 35, the sensor gear 35A is rotated according to rotation of the rotation shaft 32A. Thereby, the magnet disc 35B rotates according to the rotation of the sensor gear 35A, and the rotation is detected the respective hall ICs 35Cb of the sensor unit 35C. That is, the respective hall ICs 35Cb detect flux density according to a voltage corresponding to a magnetic flux generated by the permanent magnet 35Bd rotationally moved according to rotation of the magnet disc 35B and obtain pulse with different phases from each other. Thereby, the rotation sensor 35 can detect an opening or closing position, an opening or closing speed, and an opening or closing direction of the door 2. Even if the door 2 is opened or closed manually without using the door opening/closing device 3, the arm 34 pivots, the rotation shaft 32A rotates via the driving gear group 33 so that the magnet disc 35B rotates. Thereby, the opening or closing position, the opening or closing speed, and the opening or closing direction of the door 2 can be detected even at a manual operation of the door 2. For example, when the door 2 that has been opened manually is closed by the door opening/closing device 3, the status of the door 2 can be recognized by detecting the opening or closing position, the opening or closing speed, and the opening or closing direction of the door 2 at the manual opening or closing time of the door 2 in this manner. Besides, even when the door 2 is successively opened or closed by the door opening/closing device 3 from a manually half-opened position of the door 2, the status of the door 2 can be recognized. Detection of the opening or closing position, the opening or closing speed, and the opening or closing direction of the door 2 can be also used for reversion at a catching time or a duty control (pulse-width modulation (PWM) control).

In the door opening/closing device 3 described above, therefore, regarding the rotation sensor 35, the magnet disc 35B is provided on the one end side of the rotation shaft 32A and it has the permanent magnet 35Bd in a disc shape rotated according to rotation of the rotation shaft 32A. The rotation sensor 35 has the hall ICs 35Cb arranged on the disc face of the permanent magnet 35Bd to oppose to each other via the predetermined distance. Thus, it is possible to arrange the magnet disc 35B and the hall ICs 35Cb at positions at which the magnet disc 35B and the hall ICs 35Cb are not influenced by a magnetic field generated when the coil unit 32E in the clutch 32 is energized. As a result, the detection precision of the rotation sensor 35 is improved.

The hall ICs 35Cb are arranged at positions slightly deviated from the positions immediately above the coil unit 32E of the clutch 32 sideward, where there is a possibility that the hall ICs 35Cb are influenced at their arrangement positions by magnetic flux generated when the coil unit 32E is energized, mainly magnetic flux in left and right directions, as shown in FIG. 5. However, since the hall ICs 35Cb are arranged so as to detect vertical magnetic flux generated by the permanent magnet 35Bd and a direction of magnetic flux of the permanent magnet 35Bd detected by the hall ICs 35Cb has a positional relationship where it crosses a direction of magnetic flux influencing the hall ICs 35Cb when the coil unit 32E is energized, the hall ICs 35Cb are not influenced by the magnetic flux of the coil unit 32E. Since the magnet disc 35B and the hall ICs 35Cb are arranged at positions where they are not influenced by magnetic flux generated when the coil unit 32E in the clutch 32 is energized, the detection precision of the rotation sensor 35 is improved.

The rotation sensor 35 has the hall ICs 35Cb arranged on the disc face of the permanent magnet 35Bd to oppose to each other via the predetermined distance. Therefore, when the magnet disc 35B rotates around the supporting shaft 35Ba, even if a rotational locus of the permanent magnet 35Bd fluctuates in a radially outward direction of the supporting shaft 35Ba, a relative distance between the permanent magnet 35Bd and the hall ICs 35Cb does not fluctuate. As a result, the detection precision of the rotation sensor 35 is improved.

In the rotation sensor 35, the permanent magnet 35Bd and the hall ICs 35Cb are arranged such that the predetermined distance is given therebetween by an elastic biasing force of the compression spring 35Bc. Therefore, the relative distance between the permanent magnet 35Bd and the hall ICs 35Cb in the axial direction of the supporting shaft 35Ba is prevented from fluctuating. As a result, the detection precision of the rotation sensor 35 is improved.

The rotation sensor 35 is arranged at the one end side of the rotation shaft 32A extending outside the motor base 36 of the driving motor 31, and it is housed inside the sensor case 39 made from synthetic resin to be attached to the motor base 36. Therefore, the motor base 36 made from metal that fixes the driving motor 31 to the casing 3A constituting a device proximal portion of the door opening/closing device 3 can be downsized. As a result, the door opening/closing device 3 can be light-weighted and compact-sized.

The rotation sensor 35 is arranged at the one end side of the rotation shaft 32A extending outside the motor base 36 of the driving motor 31, and it is housed inside the sensor case 39 made from synthetic resin to be attached to the motor base 36. Therefore, it is made possible to mount a controller (not shown) for controlling the door opening/closing device 3 on the sensor base plate 35Ca housed in the sensor case 39. That is, the controller can be arranged inside the constituent elements for the door opening/closing device 3 without increasing the size of the motor base 36 made from metal. As a result, the door opening/closing device 3 can be light-weighted and compact-sized.

According to the first embodiment, rotation of the rotation shaft 32A is obtained as rotation of the magnet disc 35B via the sensor gear 35A by providing the sensor gear 35A at the one end of the rotation shaft 32A and causing the sensor gear 35A to mesh with the magnet disc 35B. The present invention is not limited to such a constitution. If the hall ICs 35Cb are arranged to satisfy a positional relationship where the direction of magnetic flux of the permanent magnet 35Bd to be detected by the hall ICs 35Cb and the direction of magnetic flux obtained when the coil unit 32E is energized cross each other, the magnet disc 35B can be provided on the rotation shaft 32A.

FIGS. 7 to 11 depict a door opening/closing device according to a second embodiment of the present invention.

Figure 7:
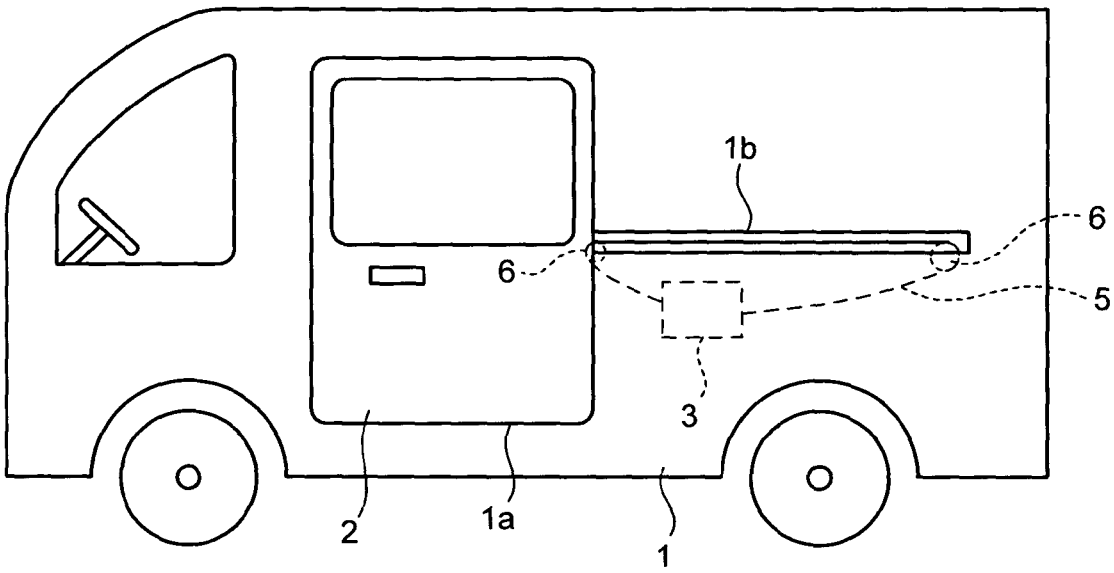
FIG. 7 is a schematic of a door opening/closing device according to a second embodiment of the present invention.

As shown in FIG. 7, the door opening/closing device 3 is disposed between the body 1 the door (for example, a slide door) 2, serving as an opening and closing member, for closing an opening 1*a* that is formed in the body 1. The door opening/closing device moves the door 2 to be opened and closed. The door 2 is movably provided to be movable along a guide rail 1*b* mounted on the body 1 in a longitudinal direction of the body 1. The door opening/closing device 3 includes a cable 5 serving as a transmission unit provided between the driving unit 300 and the door 2 via pulleys 6. The door opening/closing device 3 moves the door 2 by transmitting power of the driving unit 300 to the door 2 via the cable 5.

Figure 8:
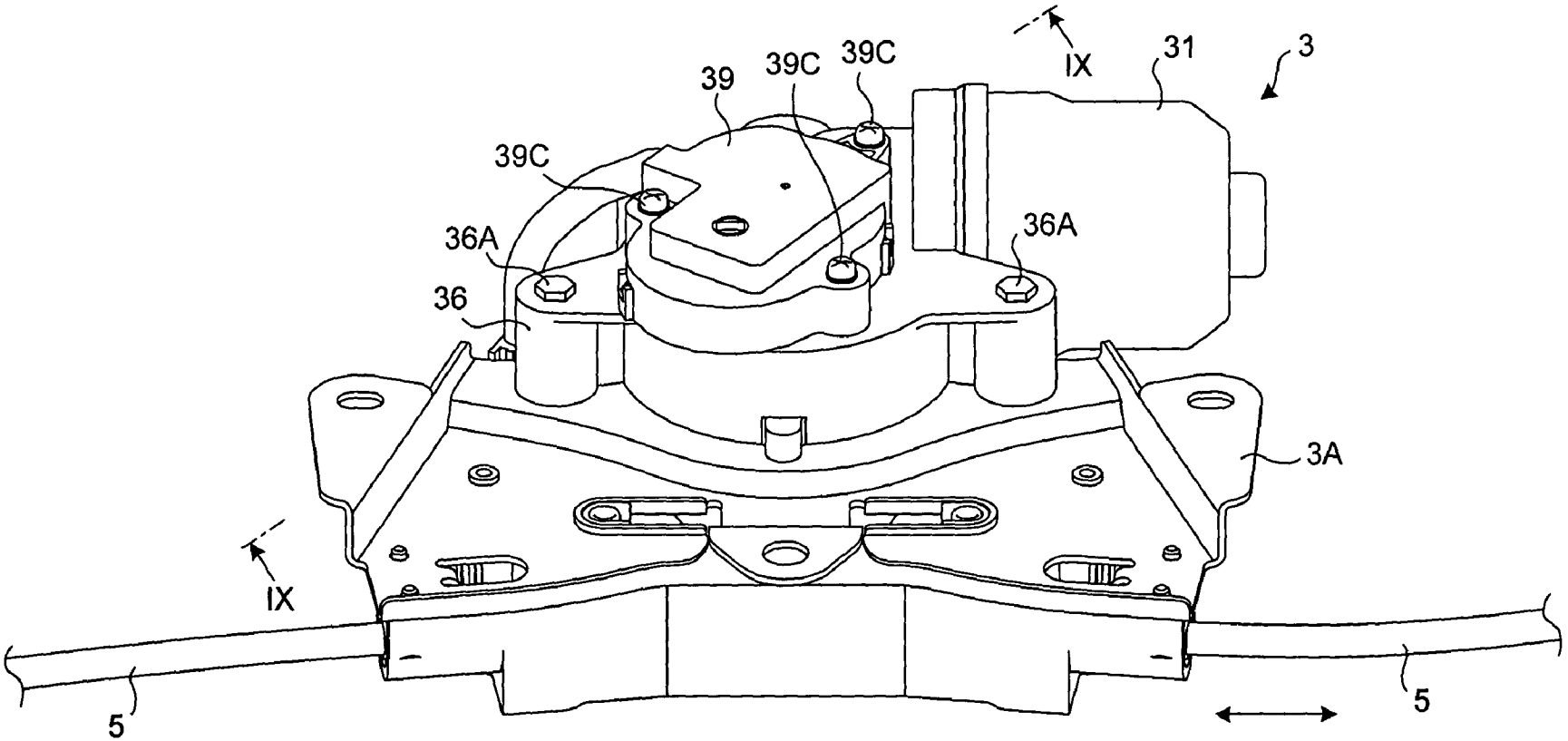
FIG. 8 is a perspective view of the door opening/closing device shown in FIG. 7.

As shown in FIG. 8, the driving unit 300 includes the driving motor 31 serving as a driving source, the clutch 32, and a rotation sensor 35 on a base 3A constituting a device base portion of the door opening/closing device 3.

The driving motor 31 is attached outside the base 3A. A worm gear (not shown) is provided on an output shaft of the driving motor 31. The driving motor 31 has the motor base 36 housing the output shaft and a worm gear therein. The motor base 36 is fixed to the base 3A by bolts 36A.

Figure 9:
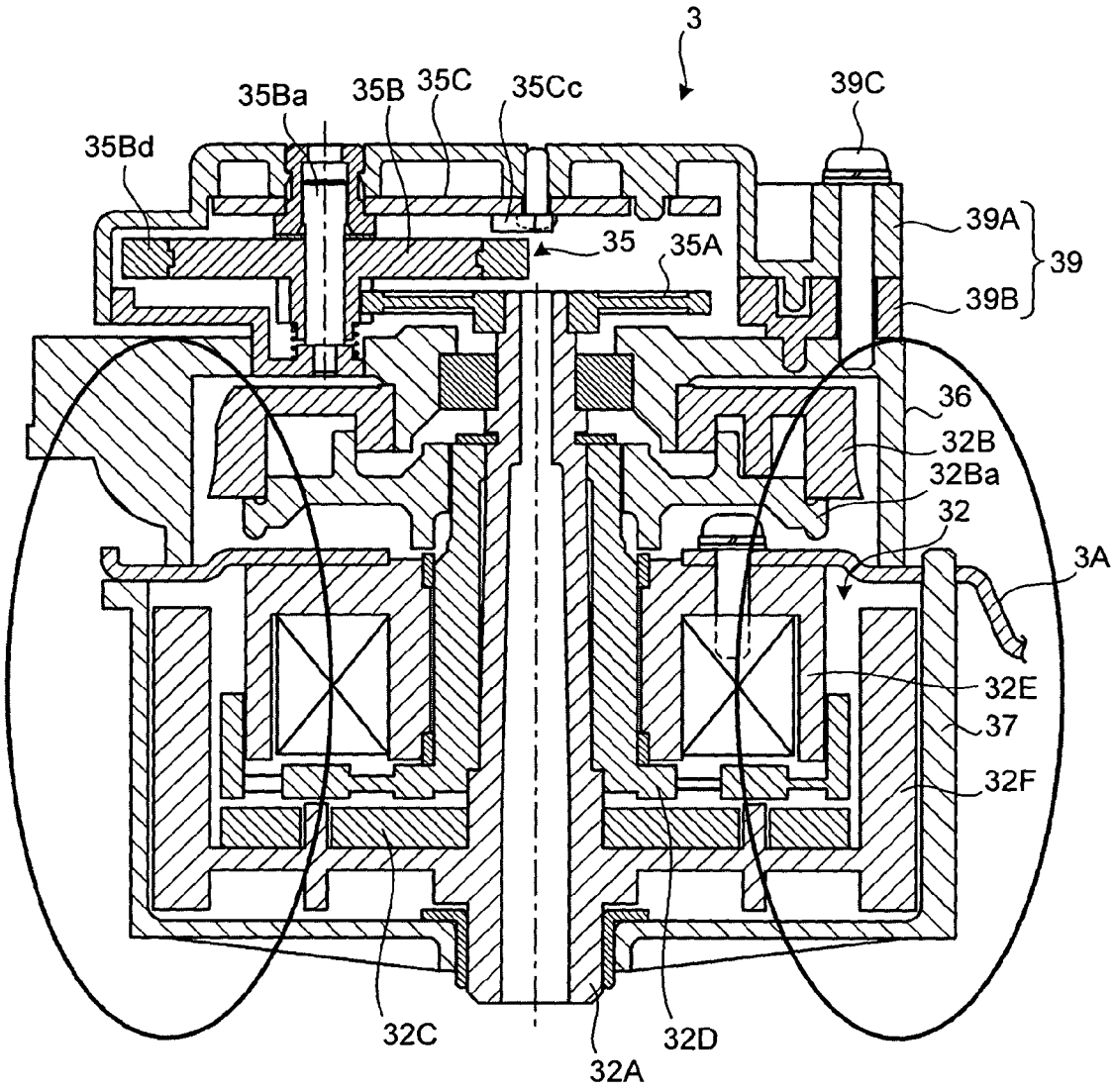
FIG. 9 is a cross-section of the door opening/closing device taken along a line IX-IX shown in FIG. 8.

As shown in FIG. 9, the clutch 32 is constituted as an electromagnetic clutch. The clutch 32 is mainly housed in the clutch case 37. The clutch case 37 is fixed to the base 3A to sandwich the base 3A between the same and the motor base 36.

The clutch 32 includes the rotation shaft 32A, the worm wheel 32B, the armature 32C, the rotor 32D, and the coil unit 32E. One end of the rotation shaft 32A is rotatably supported to the motor base 36 in a state that the rotation shaft 32A is orthogonal to the output shaft of the driving motor 31, while the other end thereof is rotatably supported to the clutch case 37. The rotation shaft 32A is formed integrally with an output drum 32F. The output drum 32F winds the cable 5 thereon, and is formed in a cylindrical shape around the rotation shaft 32A. The worm wheel 32B is provided integrally on the rotor 32D via an input 32Ba, and it meshes with the worm gear of the driving motor 31. The rotor 32D is provided around the rotation shaft 32A to be rotatable relative to the rotation shaft 32A. The armature 32C is formed in a disc shape from magnetic body, and it is inserted with the rotation shaft 32A rotatably relative to the rotation shaft 32A. The armature 32C is provided to engage with the output drum 32F in a state that it moves in the axial direction of the rotation shaft 32A and it rotates integrally with the output drum 32F. The coil unit 32E is arranged around the rotation shaft 32A and is disposed to sandwich the rotor 32D between the same and the armature 32C.

In the clutch 32, when the coil unit 32E is energized, the armature 32C is attracted toward the coil unit 32E to frictionally engage with the rotor 32D. Therefore, the rotor 32D is connected to the output drum 32F via the armature 32C. Thereby, a driving force of the driving motor 31 via the worm gear and the worm wheel 32B is transmitted to the rotation shaft 32A via the rotor 32D and the output drum 32F so that the rotation shaft 32A and the output drum 32F are rotated. As a result, the cable 5 wound on the output drum 32F is moved in a direction of allow shown in FIG. 8, so that the door 2 is moved in an opening direction or in a closing direction according to the movement of the cable 5. On the other hand, when the coil unit 32E is not energized, the armature 32C and the rotor 32D separate from each other. Thereby, relative transmission of power between the driving motor 31 and the rotation shaft 32A is released.

The rotation sensor 35 is housed inside the sensor case 39 made from synthetic resin and attached on the motor base 36. The sensor case 39 includes the upper case 39A and the lower case 39B separated from each other, and the sensor gear 35A, the magnet disc 35B, and the sensor unit 35C constituting the rotation sensor 35 are housed in a space formed between the upper case 39A and the lower case 39B.

The sensor gear 35A is fixed at an end of the rotation shaft 32A extending to the outside of the motor base 36.

Figure 10:
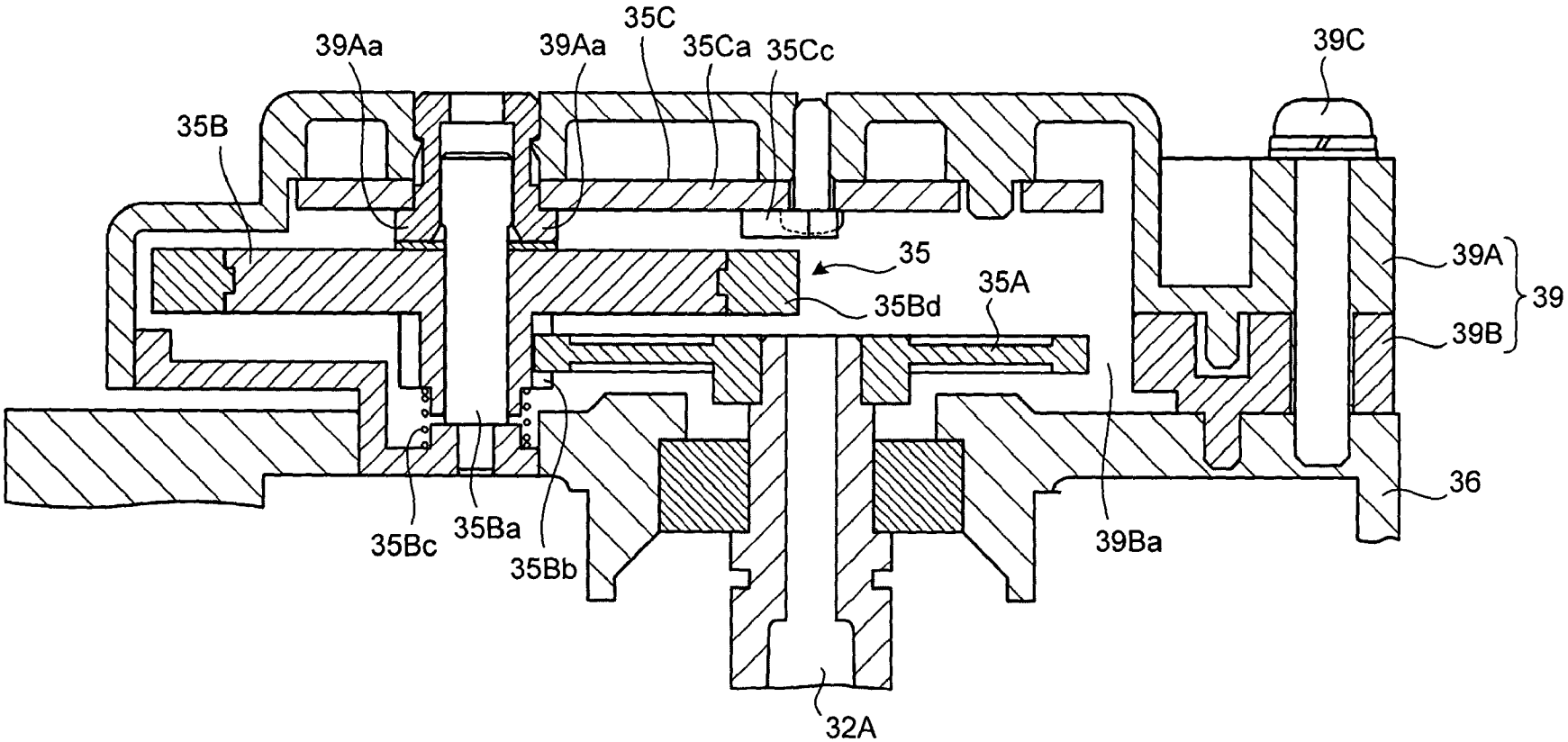
FIG. 10 is an enlarged view of a portion shown in FIG. 9.
Figure 11:
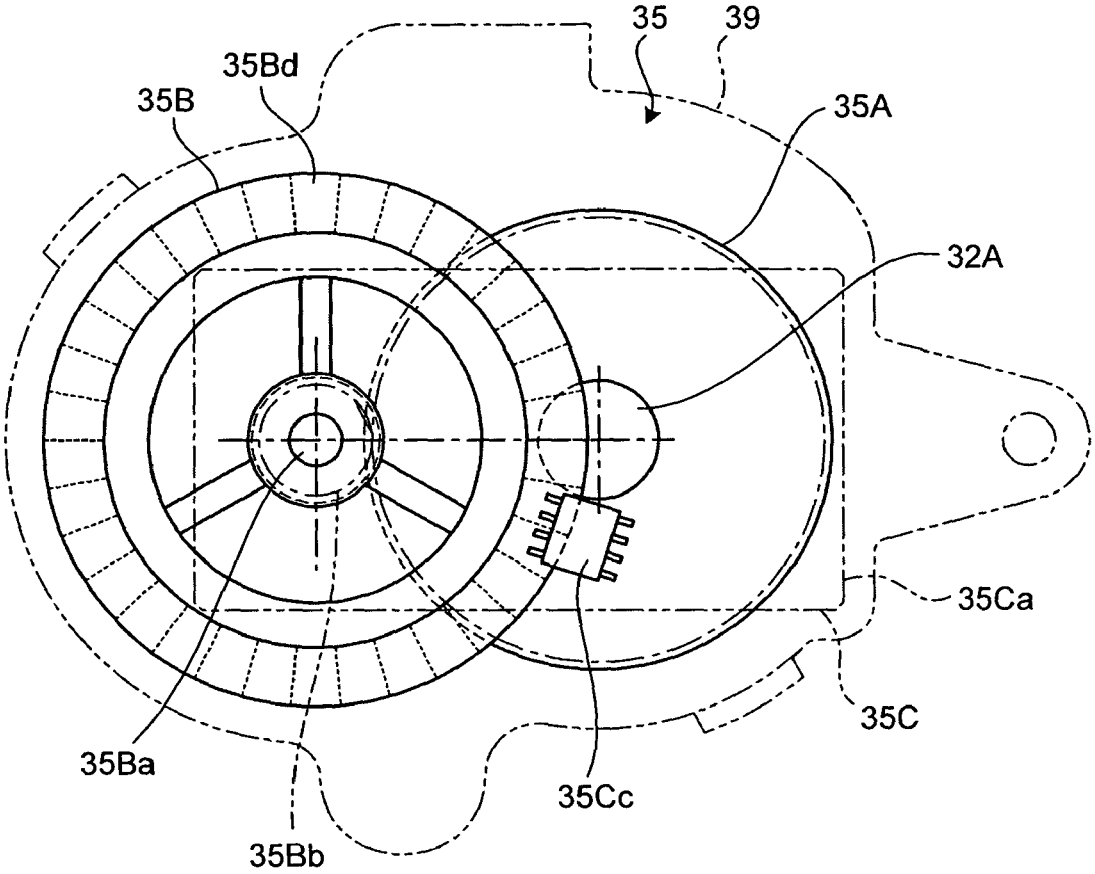
FIG. 11 is a plan view of the opening/closing device shown in FIG. 8.

The magnet disc 35B has the supporting shaft 35Ba rotatably supported to the sensor case 39. In the supporting shaft 35Ba, an upper end portion thereof is supported by the upper case 39A and a lower end portion thereof is supported by the lower case 39B. The magnet disc 35B has the meshing teeth 35Bb provided around the supporting shaft 35Ba. The meshing teeth 35Bb mesh with the sensor gear 35A. As shown in FIG. 10, the compression spring 35Bc is interposed between a lower end portion of the supporting shaft 35Ba and the lower case 39B. That is, the magnet disc 35B is elastically biased upwardly by the compression spring 35Bc. The magnet disc 35B has the permanent magnet 35Bd in a disc shape serving as a magnetic member and extending in a radially outward direction of the supporting shaft 35Ba. The permanent magnet 35Bd is provided to constitute at least an outer peripheral portion in a disc shape extending in the radially outward direction of the supporting shaft 35Ba. As shown in FIG. 11, the permanent magnet 35Bd is constituted by magnetizing positive pole (N pole) and negative pole (S pole) different in magnetic pole alternatively along a circumferential direction on a disc face (axial).

The sensor unit 35C has the sensor base plate 35Ca fixed to the upper case 39A. A magneto-resistive element 35Cc serving as the magnetism detecting element is provided on a lower face of the sensor base plate 35Ca. The magneto-resistive element 35Cc is disposed along a disc face (an upper face) of the permanent magnet 35Bd in the magnet disc 35B and at a position of an outer peripheral edge of the permanent magnet 35Bd, as shown in FIG. 11. That is, the magneto-resistive element 35Cc is fixedly arranged in a magnetic field generated by the permanent magnet 35Bd so as to detect parallel magnetic flux (left and right directions in FIGS. 9 and 10) generated from an outer peripheral edge of the permanent magnet 35Bd of the magnet disc 35B. The magneto-resistive element 35Cc is disposed at a position immediately above the coil unit 32E of the clutch 32 and near to one end of the rotation shaft 32A.

The magneto-resistive element 35Cc according to the embodiment detects the direction of magnetic flux according to a resistant value corresponding to magnetic flux generated by the permanent magnet 35B, which is a magnetic member. The magneto-resistive element 35Cc adopts an anisotropic magneto-resistive (AMR) element whose resistant value changes due to a specific magnetic field direction.

The supporting projections 39Aa are provided at a portion of the upper case 39A supporting an upper end of the supporting shaft 35Ba. The supporting projections 39Aa are caused to abut on a disc-shaped portion of the magnet disc 35B elastically biased by the compression spring 35Bc. Therefore, the permanent magnet 35Bd and the magneto-resistive element 35Cc are spaced from each other by a predetermined distance. The predetermined distance is a distance suitable for the magneto-resistive element 35Cc to detect the direction of magnetic flux from the permanent magnet 35Bd and to output the detected direction as a resistant value. Thus, the compression spring 35Bc and the supporting projections 39Aa constitute a supporting unit which elastically holds a position of the permanent magnet 35Bd to a position of the magneto-resistive element 35Cc.

In the rotation sensor 35, the opening hole 39Ba that allows insertion of the sensor gear 35A is provided in the lower case 39B. The sensor case 39 is fixed to an upper face of the motor base 36 by the fixing screws 39C so as to insert the sensor gear 35A inside via the opening hole 39Ba. At this time, the sensor gear 35A mutually meshes with the meshing teeth 35Bb of the magnet disc 35B.

In the rotation sensor 35, the sensor gear 35A is rotated according to rotation of the rotation shaft 32A. Thereby, the magnet disc 35B rotates according to the rotation of the sensor gear 35A, and the rotation is detected by the magneto-resistive element 35Cc of the sensor unit 35C. That is, the magneto-resistive element 35Cc outputs different resistant values according to directions of magnetic flux generated by the permanent magnet 35Bd rotationally moved according to rotation of the magnet disc 35B. Thus, the rotation-sensor 35 can detect an opening or closing position, an opening or closing speed, and an opening or closing direction of the door 2. Even if the door 2 is opened or closed manually without using the door opening/closing device 3, the cable 5 moves according to movement of the door 2, the rotation shaft 32A rotates via the output drum 32F so that the magnet disc 35B rotates. Thereby, the opening or closing position, the opening or closing speed, and the opening or closing direction of the door 2 can be detected even at a manual opening or closing time of the door 2. For example, when the door 2 opened manually is closed by the door opening/closing device 3, the status of the door 2 can be recognized by detecting the opening or closing position, the opening or closing speed, and the opening or closing direction of the door 2 at the manual opening or closing time of the door 2 in this manner. Besides, even when the door 2 is successively opened or closed by the door opening/closing device 3 from a manually half-opened position of the door 2, the status of the door 2 can be recognized. Detection of the opening or closing position, the opening or closing speed, and the opening or closing direction of the door 2 can be used for reversion at a catching time or a duty control, too.

In the door opening/closing device 3 described above, therefore, regarding the rotation sensor 35, the magnet disc 35 is provided at the one end side of the rotation shaft 32A and it has the permanent magnet 35Bd in a disc shape rotated according to rotation of the rotation shaft 32A. The rotation sensor 35 has the magneto-resistant element 35Cc arranged so as to be spaced from the permanent magnet 35Bd by the predetermined distance. Thus, it becomes possible to arrange the magnet disc 35B and the magneto-resistive element 35Cc at positions at which the magnet disc 35B and the magneto-resistive element 35Cc are not influenced by a magnetic field generated when the coil unit 32E in the clutch 32 is energized. As a result, the detection precision of the rotation sensor 35 is improved.

The magneto-resistive element 35Cc is arranged at a position immediately above the coil unit 32E of the clutch 32 and near to one end of the rotation shaft 32A, where there is a possibility that a portion where the magneto-resistive element 35Cc is disposed is influenced by magnetic flux, mainly magnetic flux in upward and downward directions, generated when the coil unit 32E is energized, as shown in FIG. 9. However, since the magneto-resistive element 35Cc is arranged so as to detect parallel (left and right directions in FIGS. 9 and 10) magnetic flux generated by the permanent magnet 35Bd and a direction of magnetic flux of the permanent magnet 35Bd detected by the magneto-resistive element 35Cc has a positional relationship where it crosses a direction of magnetic flux influencing the magneto-resistive element 35Cc when the coil unit 32E is energized, the magneto-resistive element 35Cc is not influenced by the magnetic flux of the coil unit 32E. Since the magnet disc 35B and the magneto-resistive element 35Cc are arranged at positions where they are not influenced by magnetic flux generated when the coil unit 32E in the clutch 32 is energized, the detection precision of the rotation sensor 35 is improved.

In the rotation sensor 35, the permanent magnet 35Bd and the magneto-resistive element 35Cc are spaced from each other by a predetermined distance by the elastic biasing force of the compression spring 35Bc. Therefore, a relative distance between the permanent magnet 35Bd and the magneto-resistive element 35Cc in the axial direction of the supporting shaft 35Ba is not prevented from fluctuating. As a result, the detection precision of the rotation sensor 35 is improved.

The rotation sensor 35 is disposed at one end side of the rotation shaft 32A extending outside the motor base 36 in the driving motor 31, and it is housed inside the sensor case 39 made from synthetic resin to be attached to the motor base 36. Therefore, the motor base 36 fixing the driving motor 31 to the casing 3A constituting a device base of the door opening/closing device 3 can be downsized. As a result, the door opening/closing device 3 can be light-weighted and compact-sized.

The rotation sensor 35 is disposed at one end side of the rotation shaft 32A extending outside the motor base 36 in the driving motor 31, and it is housed inside the sensor case 39 made from synthetic resin to be attached to the motor base 36. Therefore, it is made possible to mount a controller (not shown) for controlling the door opening/closing device 3 on the sensor base plate 35Ca housed in the sensor case 39. That is, the controller can be arranged inside the constituent elements for the door opening/closing device 3 without increasing the size of the motor base 36. As a result, the door opening/closing device 3 can be light-weighted and compact-sized.

Especially, the magneto-resistive element 35Cc is adopted as the magnetism detecting element. The magneto-resistive element 35Cc generates one pulse at its one pole (each of S pole and N pole), while the hall element 35Cb generates one pulse at two poles (S pole and N pole). In other words, the magneto-resistive element 35Cc has a pulse resolution twice that of the hall element 35Cb. Therefore, when the rotation sensor 35 using the magneto-resistive element 35Cc is set to have the same pulse resolution as the rotation sensor 35 using the hall element 35Cb, the former magnet disc 35B can be downsized. As a result, it is possible to downsize the rotation sensor 35 itself. On the other hand, the rotation sensor 35 using the magneto-resistive element 35Cc can improve the resolution when the same magnet disc 35B used for the hall element 35Cb can be used.

The magneto-resistive element 35Cc outputs two phases, while two (a pair of) hall ICs 35Cb output one phase respectively. Therefore, in the magneto-resistive element 35Cc, mounting fluctuation and concern of deviation in phase difference among phases can be reduced as compared with the hall element 35Cb.

According to the second embodiment, rotation of the rotation shaft 32A is obtained as rotation of the magnet disc 35B via the sensor gear 35A by providing the sensor gear 35A at the one end of the rotation shaft 32A and causing the magnet disc 35B to mesh with the sensor gear 35A. The present invention is not limited to such a constitution, and if the magneto-resistive element 35Cc is arranged to satisfy a positional relationship where the direction of magnetic flux of the permanent magnet 35Bd to be detected by the magneto-resistive element 35Cc and the direction of magnetic flux obtained when the coil unit 32E is energized cross each other, the magnet disc 35B can be provided on the rotation shaft 32A.

In each embodiment, the permanent magnet 35Bd constituted by magnetizing positive pole (N pole) and negative pole (S pole) different in magnetic pole alternatively along a circumferential direction on a disc face (axial) is adopted. According to the first embodiment, while the pair of hall ICs 35Cb are arranged on a disc face of the permanent magnet 35Bd to face each other so as to detect vertical magnetic flux generated from the disc face of the permanent magnet 35Bd, the hall ICs 35Cb are fixed so as to detect magnetic flux crossing magnetic flux generated by the clutch 32 at positions slightly deviated sideward from a position immediately above the coil unit 32E of the clutch 32, so that the hall ICs 35Cb is prevented from being influenced by magnetic flux of the clutch 32. According to the second embodiment, while the magneto-resistive element 35Cc is arranged along the disc face of the permanent magnet 35Bd so as to detect parallel magnetic flux generated from the outer peripheral edge of the permanent magnet 35Bd, the magneto-resistive element 35Cc is fixed at a position immediately above the coil unit 32E of the clutch 32 near to one end of the rotation shaft 32A so as to detect magnetic flux crossing magnetic flux generated by the clutch 32, so that the magneto-resistive element 35Cc is prevented from being influenced by magnetic flux of the clutch 32.

On the other hand, instead of the permanent magnet 35Bd, it is possible to adopt a permanent magnet constituted by magnetizing positive pole (N pole) and negative pole (S pole) different in magnetic pole alternatively along a circumferential direction on a circumferential side face (radial). In this case, according to the first embodiment, it is made possible to detect magnetic flux of the permanent magnet utilizing the hall ICs 35Cb by, while arranging the pair of hall ICs 35Cb to face a peripheral side face of the permanent magnet so as to detect vertical magnetic flux generated from the peripheral side face of the radial permanent magnet, fixing the hall ICs 35Cb at positions immediately above the coil unit 32E of the clutch 32 and near to one end of the rotation shaft 32A so as to detect magnetic flux crossing magnetic flux generated from the clutch 32 without being influenced by magnetic flux of the clutch 32. According to the second embodiment, magnetic flux of the permanent magnet can be detected utilizing the magneto-resistive element 35Cc without being influenced by magnetic flux of the clutch 32 by, while arranging the magneto-resistive element 35Cc along the peripheral side face of the permanent magnet so as to detect parallel magnetic flux generated from the outer peripheral edge of the radial permanent magnet, fixing the magneto-resistive element 35Cc at a position slightly deviated sideward from a position immediately above the coil unit 32E of the clutch 32 so as to detect magnetic flux crossing magnetic flux generated by the clutch 32.

With regard to the respective embodiments, the door opening/closing device that transmits power of the driving unit 300 to the spring-up type rear door 2 via the transmission rod 4 has been explained in the first embodiment, however, the present invention is not limited to this constitution. The door opening/closing device can be adopted in a door opening/closing device that opens and closes a slide door as in the second embodiment. Similarly, the door opening/closing device that transmits power of the driving unit 300 to a slide door via the cable 5 has been explained in the second embodiment; however, the present invention is not limited to this constitution. The door opening/closing device can be adopted in a door opening/closing device that opens and closes a rear door as in the first embodiment.

According to the embodiments described above, it is possible to improve detection precision of the rotation sensor.

Moreover, according to the embodiments described above, it is possible to make the rotation sensor compact.

Furthermore, according to the embodiments described above, it is possible to make the door opening/closing device light-weighted and compact-sized.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

This application claims priority from Japanese Patent Application 2005-298735, filed Oct. 13, 2005, which is incorporated herein by reference in its entirety.

What is claimed is:

1. A door opening and closing device for moving a door through rotation of a rotation shaft obtained by transmitting a drive force of a motor to the rotation shaft through an electromagnetic clutch arranged around the rotation shaft, the door opening and closing device comprising:

a rotation sensor including:

a magnetic member provided adjacent an end of the rotation shaft and rotationally moved according to the rotation of the rotation shaft, and a detecting element fixed a predetermined distance from the magnetic member and configured to detect a magnetic flux that is generated by the magnetic member, said magnetic flux crossing a direction of a magnetic flux that is generated by the electromagnetic clutch such that the detecting element is not influenced by the magnetic flux from the electromagnetic clutch;

a motor base configured to fix the motor to a device base; and a sensor case configured to house the rotation sensor therein, wherein the motor base is attached to the sensor case such that the end of the rotation shaft extends outside of the motor base and the magnetic member is rotatably arranged on a longitudinal axis which is offset relative to a longitudinal axis of the rotation shaft.

2. The door opening and closing device according to claim 1, further comprising a supporting unit having elasticity and configured to support the magnetic member at a position opposite to the detecting element with an elastic force.

3. The door opening and closing device according to claim 1, wherein the magnetic member comprises a disc with opposing upper and lower flat surfaces, wherein the detecting element includes a magneto-resistive element, and wherein the magneto-resistive element is provided at the predetermined distance from the upper flat surface of the magnetic member.

4. The door opening and closing device according to claim 1, wherein the detecting element comprises a magneto-resistive element, and wherein the magneto-resistive element is disposed at the predetermined distance from a flat disc face of the magnetic member.

5. The door opening and closing device according to claim 4, wherein the magneto-resistive element is disposed near an outer peripheral edge of the magnetic member.

6. The door opening and closing device according to claim 1, wherein the detecting element comprises a magneto-resistive element, and wherein the magneto-resistive element outputs different resistance values according to a direction of the magnetic flux generated by the magnetic member as the magnetic member is rotationally moved according to the rotation of the rotation shaft.

7. The door opening and closing device according to claim 1, wherein the motor comprises a rotor, and wherein the magnetic member is placed a distance from the rotor.

8. The door opening and closing device according to claim 1, wherein the magnetic member comprises a magnetic disc having a first diameter, wherein a coil unit of the electromagnetic clutch has a second diameter, and wherein the first diameter is less than the second diameter.

* * * * *